US006694540B2

(12) United States Patent
Mazzulla et al.

(10) Patent No.: US 6,694,540 B2
(45) Date of Patent: Feb. 24, 2004

(54) HAIR WASHING APPARATUS

(76) Inventors: James P. Mazzulla, 9077 N. Greenbrook Ct., River Hills, WI (US) 53217; Thomas J. Jarosz, 2402 N. 82nd St., Wauwatoss, WI (US) 53213; Ignatius Duros, 8550 Two Mile Rd., Franksville, WI (US) 53126; Lori Miller, W1143 Bloomfield Rd., Lake Geneva, WI (US) 53147

( * ) Notice: Subject to any disclaimer, the term of this patent is extended or adjusted under 35 U.S.C. 154(b) by 0 days.

(21) Appl. No.: 10/269,419

(22) Filed: Oct. 11, 2002

(65) Prior Publication Data

US 2003/0070217 A1 Apr. 17, 2003

Related U.S. Application Data

(60) Provisional application No. 60/329,033, filed on Oct. 12, 2001.

(51) Int. Cl.[7] ..... A45D 44/08
(52) U.S. Cl. ..... 4/522
(58) Field of Search ..... 4/515–522

(56) References Cited

U.S. PATENT DOCUMENTS 121,921 A * 12/1871 Winn ..... 4/521
367,157 A 7/1887 Norvotnick
772,763 A * 10/1904 Walters ..... 4/521
1,806,155 A 5/1931 Farrelly
2,112,669 A 3/1938 Halas
2,167,572 A * 7/1939 Howe ..... 4/518
2,281,832 A 5/1942 Cravotta
2,453,784 A 11/1948 Conjurske
2,813,275 A * 11/1957 Davenport ..... 4/517
5,146,629 A 9/1992 Barnes
5,953,768 A 9/1999 Jarosz et al.

* cited by examiner

*Primary Examiner*—Charles E. Phillips
(74) *Attorney, Agent, or Firm*—Boyle Fredrickson Newholm Stein & Gratz S.C.

(57) ABSTRACT

A hair washing apparatus and method of use of the same is provided. The apparatus includes a basin having an outer edge and an inner edge that defines an opening extending through the basin. A support structure is attached to the wash basin for vertically positioning the wash basin in a user desired position. The wash basin is formed of a generally rigid material such that when a person's head is positioned within the opening, the basin prevents the person's head from moving while the hair is being washed. The apparatus further includes a flexible tube having a lower end attached to the inner edge around the opening and an upper end through which the hair of the person may extend. The upper end engages the head below the hair such that when the hair is being washed, the wash water does not flow down the head and face of the person, but is directed into the wash basin.

18 Claims, 6 Drawing Sheets

HAIR WASHING APPARATUS

RELATED APPLICATIONS

This application claims the benefit of U.S. Provisional Application Ser. No. 60/329,033, filed Oct. 12, 2001.

FIELD OF THE INVENTION

This invention relates generally to hair washing, and in particular, to a device which discourages the hyperextension neck of a person's neck during the washing of such person's hair.

BACKGROUND AND SUMMARY OF THE INVENTION

In beauty salons and the like, it is common to wash a person's hair prior to the styling or to the setting of such hair. Similarly, hair washing is regularly provided to individuals in hospitals and nursing homes. Typically, the person whose hair is to be washed is required to lie in a supine or semi-supine position in a reclining chair with their head resting upon a curved recess formed in the edge of a wash basin or sink. Wash water is sprayed onto the person's head, and thereafter, flows directly off such head into the wash basin.

There has been a growing awareness that the washing hair procedure, as heretofore described, can induce what has come to be known as "beauty parlor stroke syndrome." More specifically, there have been instances of cervical musculoskeletal and vascular damage, e.g., vertebral carotid, when the person's neck is hyperextended over the sink or wash basin. Damage to the blood vessels in the neck can result in transient ischemic attacks and cerebral vascular accidents. Further, hyperextension of the neck may result in musculoskeletal pain and discomfort.

Heretofore, various devices have been configured for use when washing a person's hair when the person is seated in an upright position. By way of example, U.S. Pat. No. 5,953,768 to Jarosz et al discloses an apparatus for use when washing a person's hair. The apparatus of the Jarosz et al., '768 patent includes a sheet-like, liquid catch member having an radially inner edge defining an opening for receiving a person's head therethrough. While functional for its intended purpose, the flexible nature of the sheet-like liquid catch member allows for the accidental hyperextension of a person's neck during the washing of such person's hair. Consequently, it is highly desirable to provide an apparatus which limits movement of a person's neck during the washing of such person's hair.

Therefore, it is a primary object and feature of the present invention to provide a hair washing device that provides adequate support of a neck of a person during use.

It is a further object and feature of the present invention to provide a hair washing device that discourages beauty parlor stroke syndrome in the users thereof.

It is a still further object and feature of the present invention to provide a hair washing device that is simple to use and inexpensive to manufacture.

It is a still further object and feature of the present invention to provide a hair washing apparatus that may be cleansed easily after use.

In accordance with the present invention, an apparatus is provided for use when washing hair. The apparatus includes a wash basin formed from a generally rigid material that has an inner edge defining an opening for receiving a person's head therethrough. A resilient, flexible tube can be releasably secured to the wash basin around the periphery of the inner edge to encircle the person's head extending through the inner edge. The tube is formed as a sleeve with one end secured to the wash basin and the second end engaging a person's head below the hairline, such that the hair on the person's head is exposed above the tube. In this construction, the resilient tube allows water to contact the hair on the person's head without flowing downwardly onto the face or neck of the person. Also, the engagement of the flexible tube with the wash basin directs water flowing off the flexible tube into the wash basin and away from the person.

The wash basin also includes a drain passageway extending downwardly from one end of the wash basin. The passageway is in communication with the interior of the wash basin such that water directed by the flexible tube into the wash basin flows downwardly along the basin and into the passageway in order to discard the used water. The passageway is also preferably integrally formed with a mounting element that is releasably attachable to a telescoping rod that extends downwardly away from the wash basin. By adjusting the length of the rod, the basin can be raised or lowered to accommodate people of different heights, such that the basin and flexible tube are properly positioned around the head of the person.

In accordance with a further aspect of the present invention, a method is provided for washing hair. The method includes the step of providing a washing apparatus having a generally rigid wash basin and a support structure. The wash basin has a radially outer edge and a radially inner edge that defines an opening for receiving the head of a person. The support structure is attached to the basin for adjustably vertically supporting the basin over a supporting surface. The head is placed within the opening and the hair on the head, positioned within the opening, is washed.

The step of placing the head within the opening includes the additional step of caising the basin with respect to the supporting surface. The head is then positioned beneath the opening in the basin and the basin is lowered to position the head within the opening. A lower end of a flexible tube may be attached around the inner edge prior to the lowering of the basin. The head is placed within the flexible tube and the hair is pulled through the upper end of the flexible tube such that the flexible tube engages the upper end of the flexible tube below the hair line.

In accordance with a further aspect of the present invention, a device is provided for facilitating the washing of the hair on the head of an individual. The device includes a wash basin having a generally vertical outer wall, a generally vertical inner wall, and a lower wall. The outer wall, inner wall and lower wall of the wash basin define a water receiving cavity. In addition, the inner wall defines an opening for allowing the head of the individual to pass therethrough. A support structure is provided for supporting the wash basin over a supporting surface at a predetermined angle thereto. A flexible tube has an upper end engageable with the head and a lower end. A connection structure releasably maintains a water tight connection between the lower end of the flexible tube and an inner wall of the wash basin.

It is contemplated that the connection structure include a resilient band wrapped around the lower end of the flexible tube and around the inner wall of the wash basin. Alternatively, the construction structure may include an end cap removably mounted to the inner wall for retaining the lower end of the flexible tube in engagement with the inner wall. The lower end of the flexible tube may include a resilient portion for engaging the inner wall and establishing the water tight connection. The flexible tube is generally conical in shape such that the upper end has a smaller dimension than the lower end.

Various other objects and advantages of the present invention will be made apparent from the following detailed description taken together with the drawings.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE INVENTION

Figure 1:
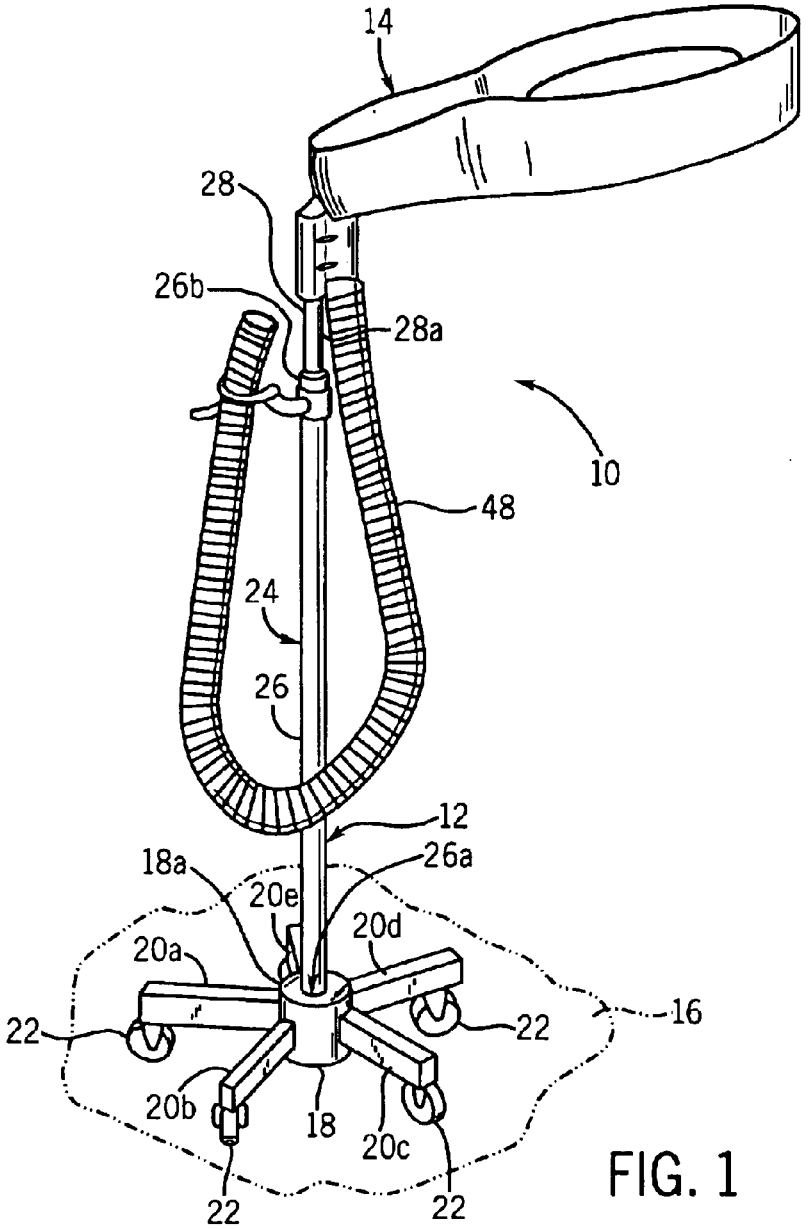
FIG. 1 is an isometric view of a hair washing device in accordance with the present invention.

Referring to FIG. 1, a hair washing apparatus in accordance with the present invention is generally designated by the reference numeral 10. Hair washing apparatus 10 includes support assembly 12 for supporting wash basin structure 14 above supporting surface 16. Support assembly 12 includes a generally cylindrical base 18 having a plurality of legs 20*a*–20*e* projecting radially therefrom. Wheels 22 are rotatably mounted to corresponding terminal ends of legs 20*a*–20*e* so as to allow hair washing apparatus 10 to be rolled along supporting surface 16 to a desired location.

Support assembly 12 further includes a vertically adjustable support 24 projecting from base 18. Support 24 includes a generally hollow tube member 26 having a first end 26*a* rigidly connected to upper surface 18*a* of base 18 and a second opposite end 26*b*. Support 24 further includes a rod 28 having a first end 28*a* telescopically received within second end 26*b* of tube member 26 so as to allow for the vertical adjustment of the overall height of hair washing apparatus 10. Second end 28*b*, best shown in FIG. 3, of rod 28 is received within a cavity 30 formed in mounting element 32 depending from one end of wash basin structure 14. A clamping element (not shown) may be used to secure rod 28 within tube member 26 such that support 24 is of a user selected height. When secured to the rod 28, the basin structure 14 is angled downwardly from the end of the basin structure 14 opposite the rod 28 to the mounting element 32. However, it is also contemplated that the mounting element 32 can be pivotally attached to the basin structure 14, such that the basin structure 14 can be moved to a desired angular position with respect to the rod 28.

Figure 4:
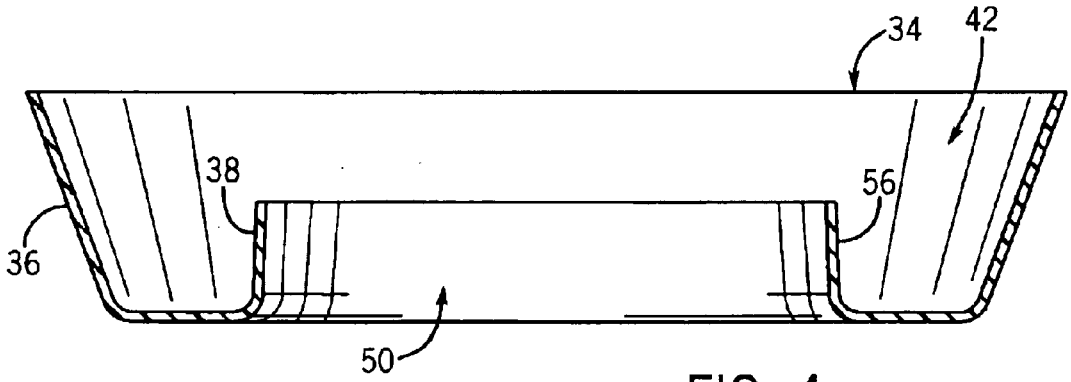
FIG. 4 is a cross-sectional view of the hair washing device of the present invention taken along line 4—4 of FIG. 2.
Figure 2:
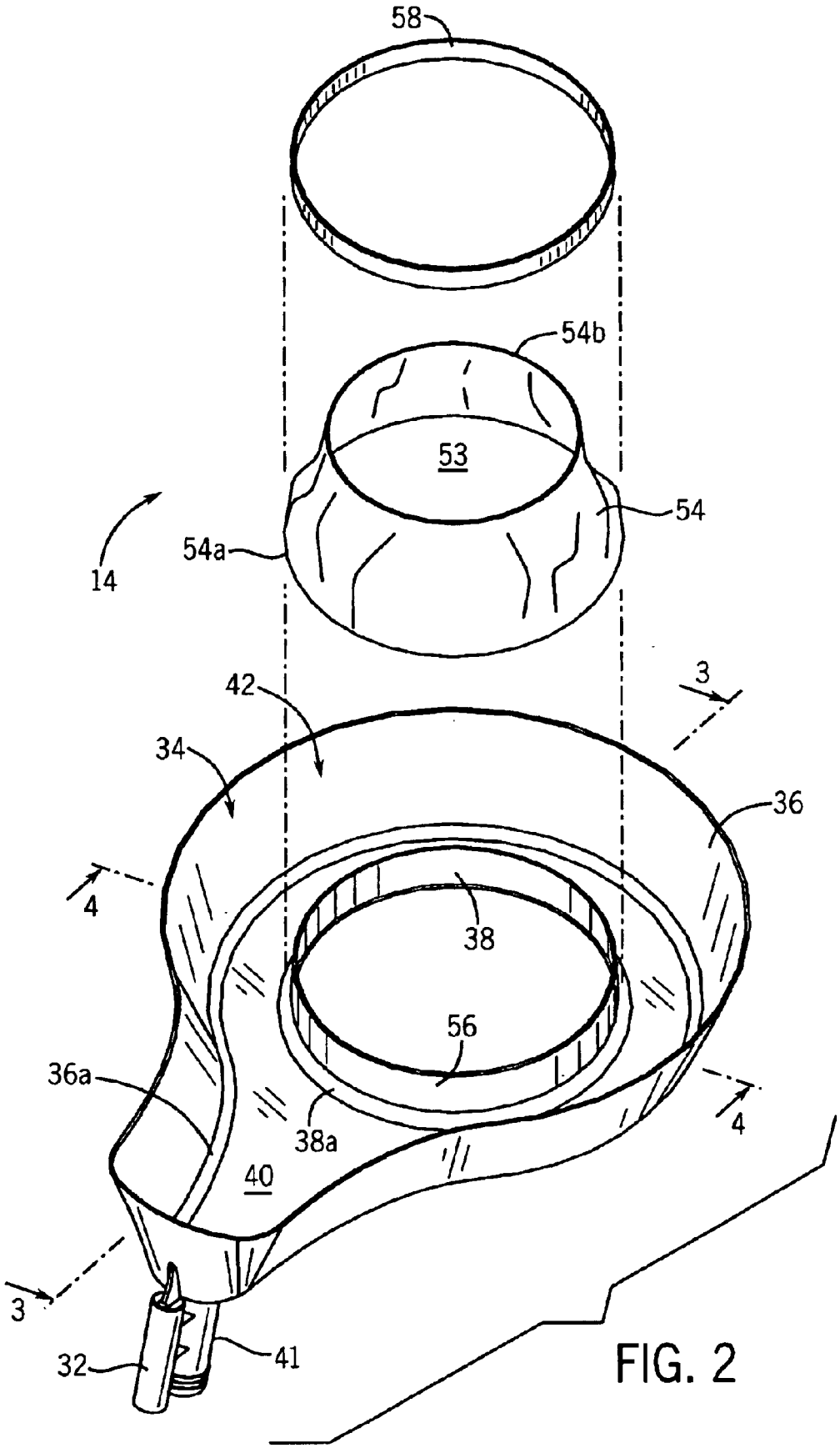
FIG. 2 is an exploded, isometric view of a portion of the hair washing device of FIG. 1.
Figure 3:
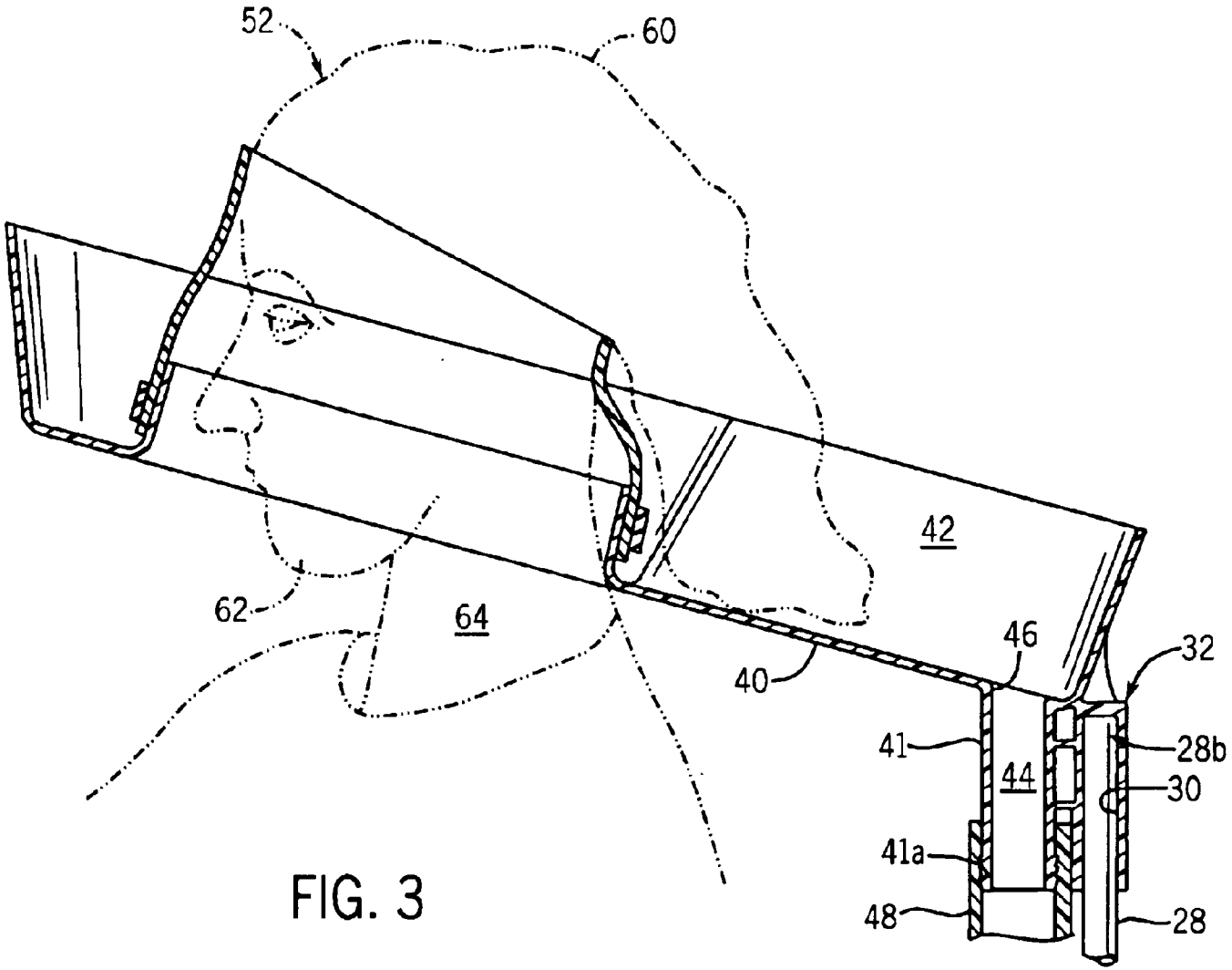
FIG. 3 is a cross-sectional view of the hair washing device of the present invention taken along line 3—3 of FIG. 2.
Figure 5:
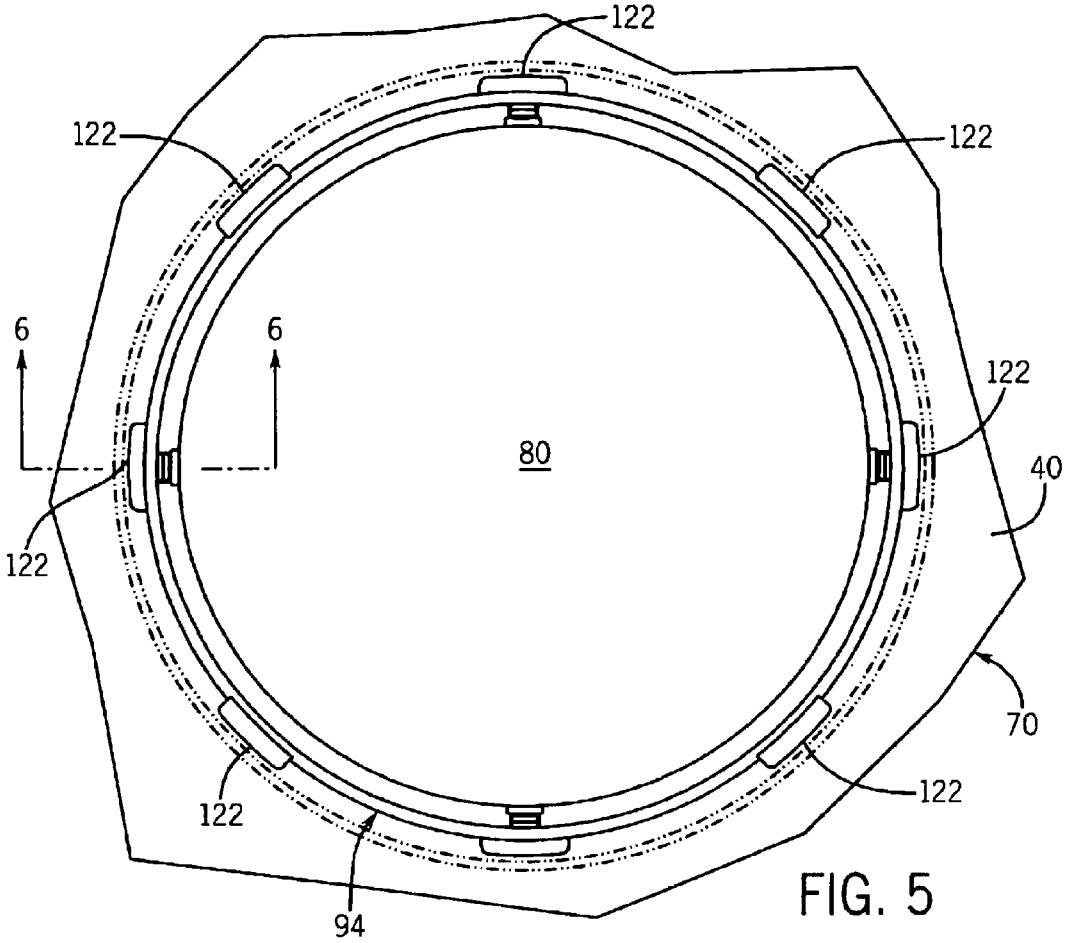
FIG. 5 is a top plan view of an alternate embodiment of the a portion of the hair washing device of the present invention.
Figure 9:
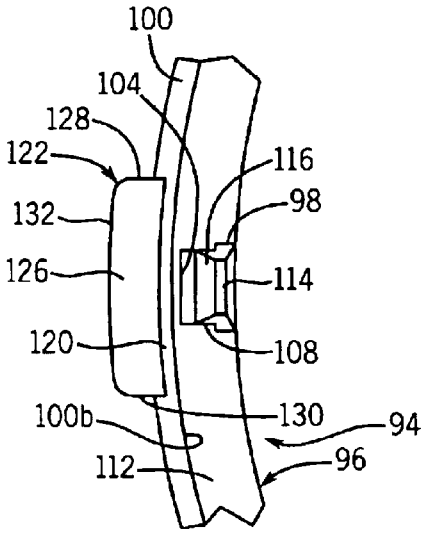
FIG. 9 is a cross-sectional view of the portion of the hair washing device of the present invention taken along line 9—9 of FIG. 8.
Figure 10:
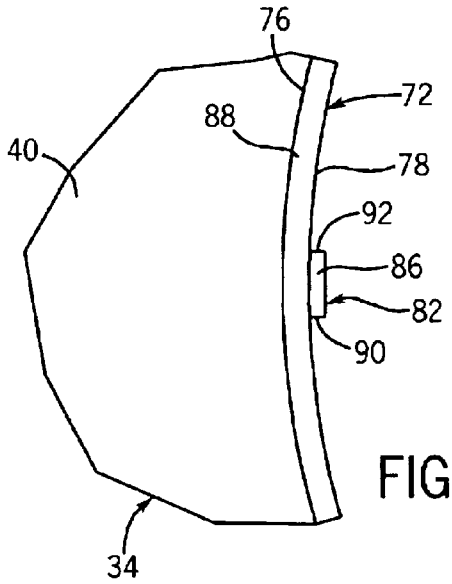
FIG. 10 is a cross-sectional view of the portion of the hair washing device of the present invention taken along line 10—10 of FIG. 8.

Referring to FIGS. 2–4, wash basin structure 14 includes a wash basin 34 having a vertically extending, radial outer wall 36 and a vertically extending, radial inner wall 38. Lower edge 36*a* of outer wall 36 of wash basin 34 and lower edge 38*a* of inner wall 38 of wash basin 34 are interconnected by bottom wall 40. Outer wall 36, inner wall 38 and bottom wall 40 of wash basin 34 define cavity 42 for receiving wash water, as hereinafter described. Mounting tube 41 depends from bottom wall 40 at one end of wash basin 34. Preferably, the mounting tube 41 is located immediately adjacent the mounting element 32. Mounting tube 41 includes a passageway 44 therethrough which communicates with cavity 42 defined by wash basin 34 through an opening 46 in bottom wall 40 of wash basin 34. Hose 48 is operatively connected to terminal end 41*a* of mounting tube 41 in order to mount hose 48 to wash basin 34. Hose 48 allows the wash water in cavity 42 to drain from water basin 34, as hereinafter described.

Inner wall 38 of wash basin 34 defines a generally circular opening 50 for allowing the user's head 52 to pass through wash basin 34. It is intended that head 52 of a person whose hair 60 is to be washed be passed through the opening 50 and into the interior 53 of a resilient, flexible tube 54. The tube 54 is formed of any suitable flexible and water impervious material, such as a soft plastic, that can be transparent, translucent, or opaque. The tube 54 preferably has a slightly conical shape, with a wide lower end 54*a* and a narrow upper end 54*b*, but can also be cylindrical. Lower end 54*a* of flexible tube 54 is positioned about the outer surface 56 of inner wall 38 of wash basin 34 and is secured thereto in a water tight relationship by connection element 58. In a preferred embodiment, connection element 58 takes the form of a rubber band, but other types of securing devices such as straps or the like may be used without deviating from the scope of the present invention.

Upper end 54*b* of resilient tube 54 has a reduced diameter that engages head 52 in a water tight manner at a location below the hairline of the user's hair 60 such that the user's hair 60 is isolated from the remaining portions 62 of user's head 52 which are positioned below the upper end 54*b* within the interior 53 of flexible tube 54. The upper end 54*b* may also include a securing member (not shown) such as an elastic band that enables the upper end 54*b* to conform to the particular shape of the head 52. As a result, wash water sprayed onto hair 60 of head 52 flows down the exterior of the tube 54 into cavity 42 defined by wash basin 34 and not onto the face or body of the person whose hair 60 is being washed. As stated previously, in the preferred embodiment, bottom wall 40 of wash basin 34 slops downwardly such that the used or dirty wash water flows from within cavity 42 into connection tube 41 through opening 46 in bottom wall 40. Thereafter, the wash water is carried by the hose 48 connected to the terminal end 41*a* of connection tube 41 to a remote, user desired location such as a sink or the like.

It can be appreciated that given the rigidity of wash basin 34, head 52 will be maintained in a vertical position during the washing of hair 60 so as to prevent hyperextension of neck 64 of the person whose hair 60 is being washed. It is contemplated to mold wash basin 34 from a rigid, plastic material. However, wash basin 34 may be formed from other types of materials without deviating from the scope of the present invention.

Referring to FIGS. 5–10, an alternate construction for a portion of wash basin 34 is generally designated by the reference numeral 70. Portion 70 of wash basin 34 includes a generally vertical inner wall 72 that is contiguous with radially inner edge 74 of bottom wall 40. Inner wall 72 includes an outer surface 76 that, along with bottom wall 40 and outer wall 36, define cavity 42 for receiving wash water, as heretofore described. Inner surface 78 of inner wall 72 defines a generally circular opening 80 in wash basin 34 for allowing the user's head to pass therethrough for reasons hereinafter described.

Inner surface 78 of inner wall 72 further includes a plurality of circumferentially spaced tangs 82 projecting radially inward from inner surface 78 of inner wall 72. Tangs 82 are defined by generally horizontal ledges 84 which extend radially inwardly from inner surface 78 of inner wall 72 at an angle approximately equal 90 degree, and angled surfaces 86 which extends from the terminal ends of ledges 84 to the terminal end 88 of inner wall 72, and vertical end faces 90 and 92. As hereinafter described, it is intended that tangs 82 be used to retain a generally circular end cap on inner wall 72 of portion 70 of wash basin 34.

The end cap 94 is positioned over terminal end 88 of inner wall 72 to facilitate the mounting of flexible tube 54 to inner wall 72 of wash basin 34. End cap 94 is defined by generally horizontal upper wall 96 having circumferentially spaced inner leg segments 98 and outer leg 100 depending from opposite ends thereof. Inner surfaces 98*a* of inner leg segments 98 and inner surface 100*a* of leg 100 define recess 102 therebetween for receiving terminal end 88 of inner wall 72. Upper wall 96 of end cap 94 includes a plurality of circumferentially spaced apertures 104 therein that communicate with recess 102. Apertures 104 have a generally rectangular cross-section that allow a user to align tangs 108 projecting from inner surface 98*a* of inner leg segments 98 for reasons hereinafter described.

Tangs 108 include generally horizontal surfaces 110 that project radially outward from inner surfaces 98*a* of inner leg segments 98 at right angles thereto. Horizontal surfaces 110 of tangs 108 are vertically spaced from lower surface 112 of upper wall 96 a sufficient axial distance to allow tangs 82 projecting from inner wall 72 to be received within recess 102 in end cap 94. Horizontal surfaces 110 of tangs 108 are interconnected to corresponding terminal ends 114 of inner leg segments 98 of end cap 96 by angled surfaces 116.

Inner surface 100*a* of outer wall 100 includes a first arcuate portion 118 that depends from lower surface 112 of upper wall 96 and that diverges from inner surfaces 98*a* of inner leg segments 98 so as to facilitate the mounting of end cap 94 of terminal end 88 of inner wall 72. In addition, inner surface 100*a* of leg 100 includes flexible tube retaining portion 120 that extends radially outward at a predetermined angle.

End cap 94 further includes a plurality of circumferentially spaced retaining tabs 122 projecting radially outward from outer surface 100*b* of outer wall 100. Retaining tabs 122 include upper surfaces 124 that are contiguous with outer surface 100*b* of outer wall 100, lower surfaces 126 extending radially outward from retaining portion 120 of inner surface 100*a* of outer wall 100, end faces 128 and 130, and radially outer vertical surfaces 132.

In order to interconnect end cap 94 to inner wall 72, end cap 94 is positioned such that tangs 98 projecting from inner surfaces 98*a* of inner leg segments 98 overlap tangs 82 projecting from inner surface 78 of inner wall 72. Apertures 104 through upper wall 96 facilitates the alignment of end cap 94 on inner wall 72. Thereafter, end cap 94 is pressed downwardly onto inner wall 72 such that angled surfaces 116 of tangs 108 slide along angled surfaces 86 of tangs 82 thereby deflecting leg segments 98 radially inward until such point that angled surfaces 116 of tangs 108 disengage from inner surfaces 86 of tangs 82 thereby allowing inner leg segments 98 to return to their original position. In their original position, horizontal surfaces 84 of tangs 82 overlap horizontal surfaces 114 of tangs 108 thereby retaining end cap 94 on inner wall 72.

Alternatively, in order to interconnect end cap 94 and inner wall 72, end cap 94 may be positioned on inner wall 72 such that inner wall 72 is received within recess 102 in end cap 94 and such that tangs 108 are circumferentially spaced from tangs 82. Thereafter, end cap 94 may be rotated on inner wall 72 in either a clockwise or counterclockwise manner until such point as horizontal surfaces 84 of tangs 82 overlap horizontal surfaces 114 of tangs 108 thereby retaining end cap 94 on inner wall 72.

Figure 6:
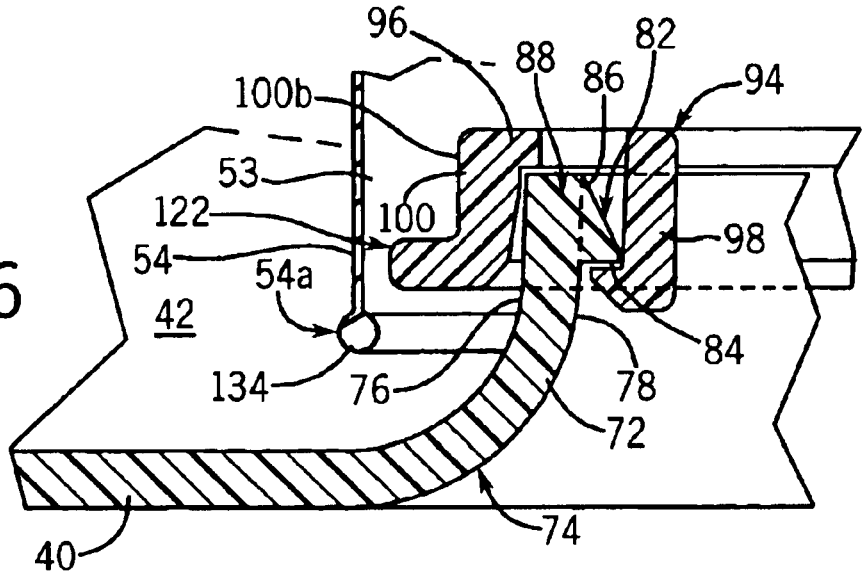
FIG. 6 is a cross-sectional view of the portion of the hair washing device of the present invention taken along line 6—6 of FIG. 5.
Figure 7:
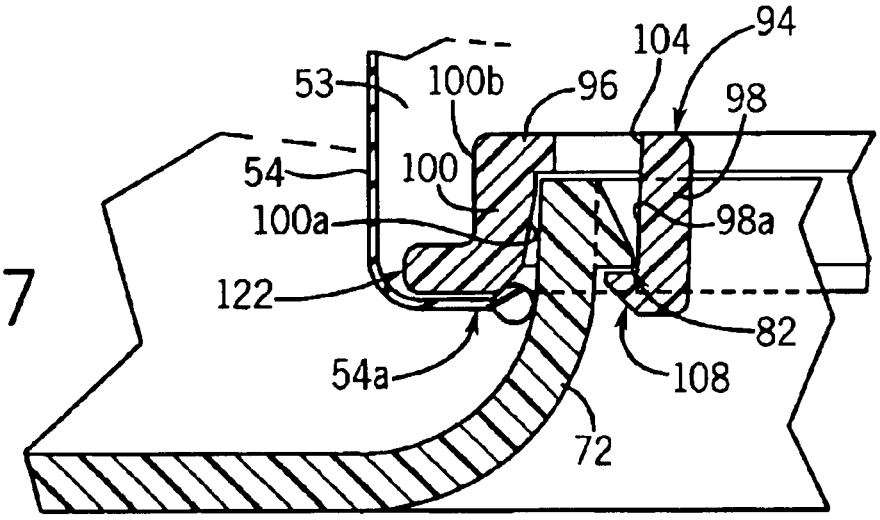
FIG. 7 is a cross-sectional view, similar to FIG. 6, showing the portion of the hair washing device of the present invention.
Figure 8:
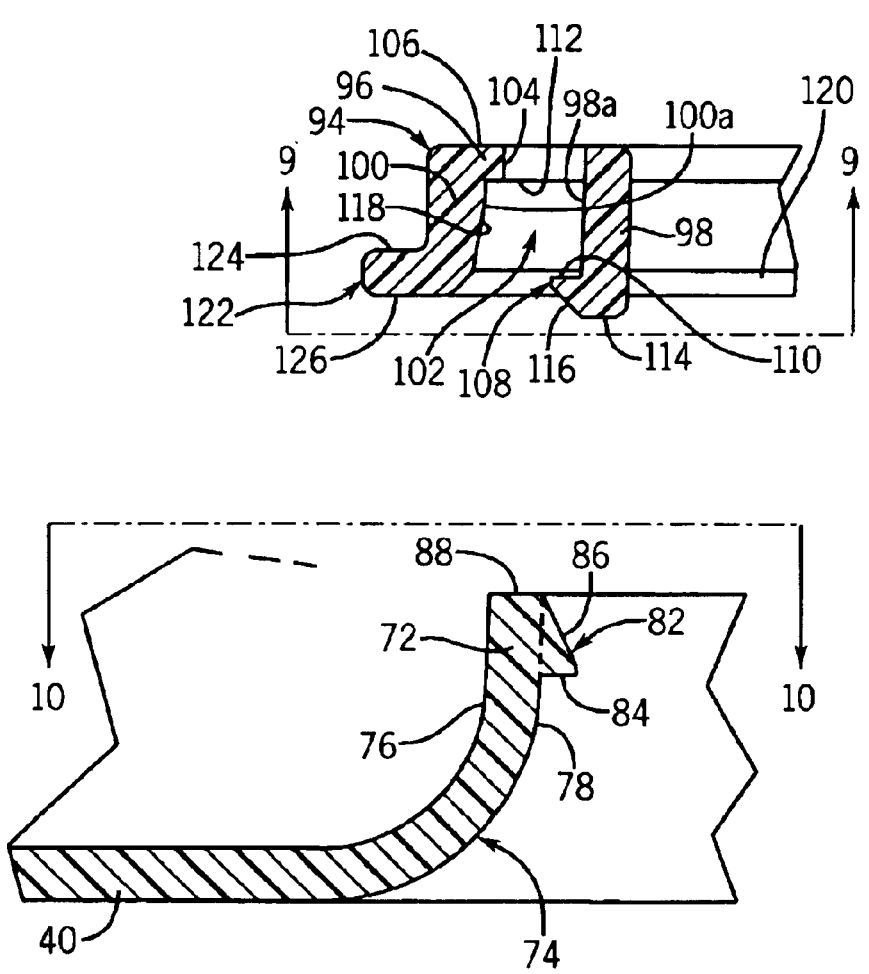
FIG. 8 is an exploded, cross-sectional view showing a portion of the hair washing device of FIG. 5.

With end cap 94 mounted on inner wall 72, lower end 54*a* of flexible tube 54 is positioned over end cap 94 such that retaining tabs 122 are received within interior 53 thereof. As best seen in FIGS. 6–7, it is contemplated to provide a resilient band 134 along lower end 54*a* of flexible tube 54 such that upon release, resilient band 134 at lower end 54*a* of flexible tube 54 becomes seated between retaining portion 120 of inner surface 100*a* of outer wall 100 of end cap 94 and outer surface 76 of inner wall 72. Alternatively, it is contemplated to position lower end 54*a* of flexible tube 54 about outer surface 76 of inner wall 72 of wash basin 34 prior to interconnecting end cap 94 to inner wall 72. Thereafter, end cap 94 is mounted on inner wall 72 of wash basin 74, as heretofore described, thereby capturing flexible tube 54 between horizontal surfaces 84 of tangs 82 and horizontal surfaces 110 of tangs 108.

With flexible tube 54 interconnected to wash basin 34, head 52 of a person whose hair 60 is to be washed may be passed through opening 50 into interior 53 of flexible tube 54. Upper end 54*b* of flexible tube 54 engages head 52 in a water tight manner at a location below the hair line of the user's hair 60 such that the user's hair 60 is isolated from the remaining portion 62 of user's head 52. Upper end 54 may also include a securing member (not shown) such as an elastic band that enables the upper end 54 to conform to the particular shape of head 52.

In operation, wash water sprayed onto hair 60 of head 52 flows downwardly into cavity 42 in wash basin 34. It can be appreciated that the wash water does not flow onto the face or body of the person whose hair 60 is being washed. As heretofore described, bottom wall 40 of wash basin 34 slopes downwardly such that wash water flows from cavity 42 into connection tubes 31 through opening 46 in bottom wall 40 of wash basin 34. Thereafter, the wash water is carried by hose 48 connected to terminal end 41*a* of connection tube 41 to a remote, user desired location such as a sink or the like.

As heretofore described, the rigidity of wash basin 34 allows head 52 to maintain in a vertical position during the washing of hair 60 so as to prevent hyperextension of neck 64 of the person whose hair 60 is being washed. Wash basin 34, including portion 70, may be molded from a rigid, plastic material. However, wash basin 34 may be formed from other types of material from deviating from the scope of the present invention. In addition, it is contemplated that to integrally mold end cap 94 and inner wall 72 of wash basin 34 as a single unit without deviating from the scope of the present invention.

Various modes of carrying out the invention are contemplated as being within the scope of the following claim particularly pointing and distinctly claiming the subject matter which is regarded as the invention.

We claim:

1. An apparatus for use in washing a person's hair, comprising:

a generally rigid wash basin having a radial inner edge defining an opening for allowing a head of the person to pass therethrough and a radial outer edge, the inner and outer edges of the wash basin defining a wash water receipt cavity therebetween;

an end cap removably mounted to the inner edge of the wash basin; and a support structure for supporting the wash basin over a supporting surface, the support structure being vertically adjustable.

2. The apparatus of claim 1 further comprising a flexible tube having an upper end and a lower end that is releasably connectible to the inner edge over the opening at the lower end.

3. The apparatus of claim 2 wherein the flexible tube is generally conical in shape and includes a narrow upper end and a wide lower end.

4. The apparatus of claim 2 further comprising a connection member engageable with the lower end of the tube around the inner edge of the wash basin.

5. The apparatus of claim 1 wherein:

the wash basin includes a water opening through which water can flow out of the basin; and a connection tube disposed beneath the water opening.

6. The apparatus of claim 5 further comprising a hose releasably connected to the connection tube opposite the basin.

7. The apparatus of claim 5 wherein the connection tube and opening are disposed adjacent the support structure.

8. The apparatus of claim 1 wherein the support structure includes a mounting element attached to and extending outwardly from the basin.

9. The apparatus of claim 8 wherein the support structure is fixedly secured to the basin.

10. The apparatus of claim 9 wherein the mounting structure is integrally formed with the basin.

11. The apparatus of claim 8 wherein the support structure includes a telescoping rod secured to the mounting element.

12. The apparatus of claim 8 wherein the mounting element extends outwardly from the basin at an angle of greater than 90 degrees.

13. The apparatus of claim 1 further comprising a flexible tube having an upper end for engagement with a head of the person and a lower end releasably maintained against to the inner edge of the wash basin with the end cap.

14. A device for facilitating the washing of hair on a head of an individual, comprising:

a wash basin having a generally vertical outer wall, a generally vertical inner wall, and a lower wall that define a water-receiving cavity, the inner wall further defining an opening for allowing the head to pass therethrough;

a support structure for supporting the wash basin over a supporting surface at a predetermined angle thereto;

a flexible tube having an upper end engageable with the head and a lower end; and connection structure for releasably maintaining a water tight connection between the lower end of the flexible tube and the inner wall of the wash basin, the connection structure including an end cap removably mounted to the inner wall for retaining the lower end of the flexible tube in engagement with the inner wall.

15. The device of claim 14 wherein the connection structure includes a resilient band wrapped around the lower end of the flexible tube and around the inner wall of the wash basin.

16. The device of claim 14 wherein the lower end of the flexible tube includes a resilient portion for engaging the inner wall and establishing the water tight connection.

17. The device of claim 14 wherein the flexible tube is generally conical in shape such that upper end has a smaller dimension than the lower end.

18. The apparatus of claim 14 wherein:

the lower wall of the wash basin includes an opening therethrough which allows for water to drain from the wash basin; and a connection tube disposed beneath the opening.

* * * * *